US005224251A

United States Patent [19]

Cameron et al.

[11] Patent Number: 5,224,251

[45] Date of Patent: Jul. 6, 1993

[54] ELECTRICAL HARNESS ASSEMBLY APPARATUS

[75] Inventors: John Cameron, Woodridge; Robert W. DeRoss, Naperville, both of Ill.; Ronald Dudek, Maumelle, Ark.; Steven F. Wright, Glen Ellyn; Hasmukh Shah, Wheaton, both of Ill.

[73] Assignee: Molex Incorporated, Lisle, Ill.

[21] Appl. No.: 852,118

[22] Filed: Mar. 16, 1992

Related U.S. Application Data

[62] Division of Ser. No. 392,808, Aug. 10, 1989.

[51] Int. Cl.[5] ..... H01R 43/04

[52] U.S. Cl. ..... 29/33 M; 29/33 P; 29/564.4; 29/749

[58] Field of Search ..... 29/33 M, 748, 749, 563, 29/564.4, 33 P, 884

[56] References Cited

U.S. PATENT DOCUMENTS 4,171,566 10/1979 Tominoi ..... 29/748
4,476,628 10/1984 Kees, Jr. ..... 29/749 X
4,916,811 4/1990 Uehara et al. ..... 29/564.4 X

*Primary Examiner*—Z. R. Bilinsky
*Attorney, Agent, or Firm*—Charles S. Cohen

[57] ABSTRACT

A system for manufacturing wire harness assemblies is provided. Each wire harness includes a shielded cable having a plurality of insulated conductors therein, with each conductor being terminated at its respective opposed ends and with the terminated ends being mounted in connector housings. The system includes a plurality of pallets that are movable along a conveyor to work stations at which various assembly steps are carried out. A first station is provided for mounting the cables to the pallet, such that the wires at the opposed ends are mounted in fixtures. A second station may selectively deposit drop wires into fixtures on the pallets. A third station trims and strips the ends of the wires and aligns the drop wires with the cable wires. A fourth station sequentially crimps terminals to the ends of the wires, with the pallet being indexable between successive crimps. The crimp apparatus adjusts to the required crimp height depending on the presence or absence of drop wires and the presence or absence of grounding clips. A fourth station tests for the presence of the terminals and inserts the terminated wires into housings.

12 Claims, 11 Drawing Sheets

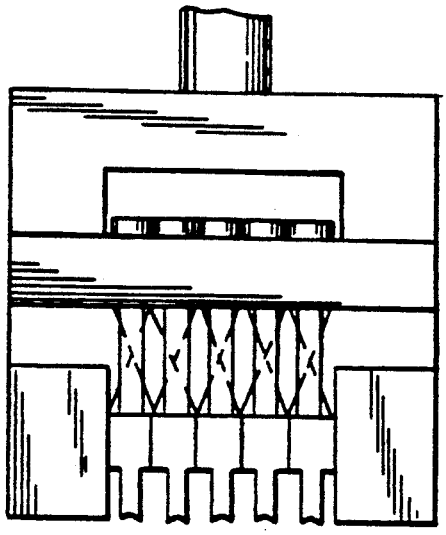
FIG.9
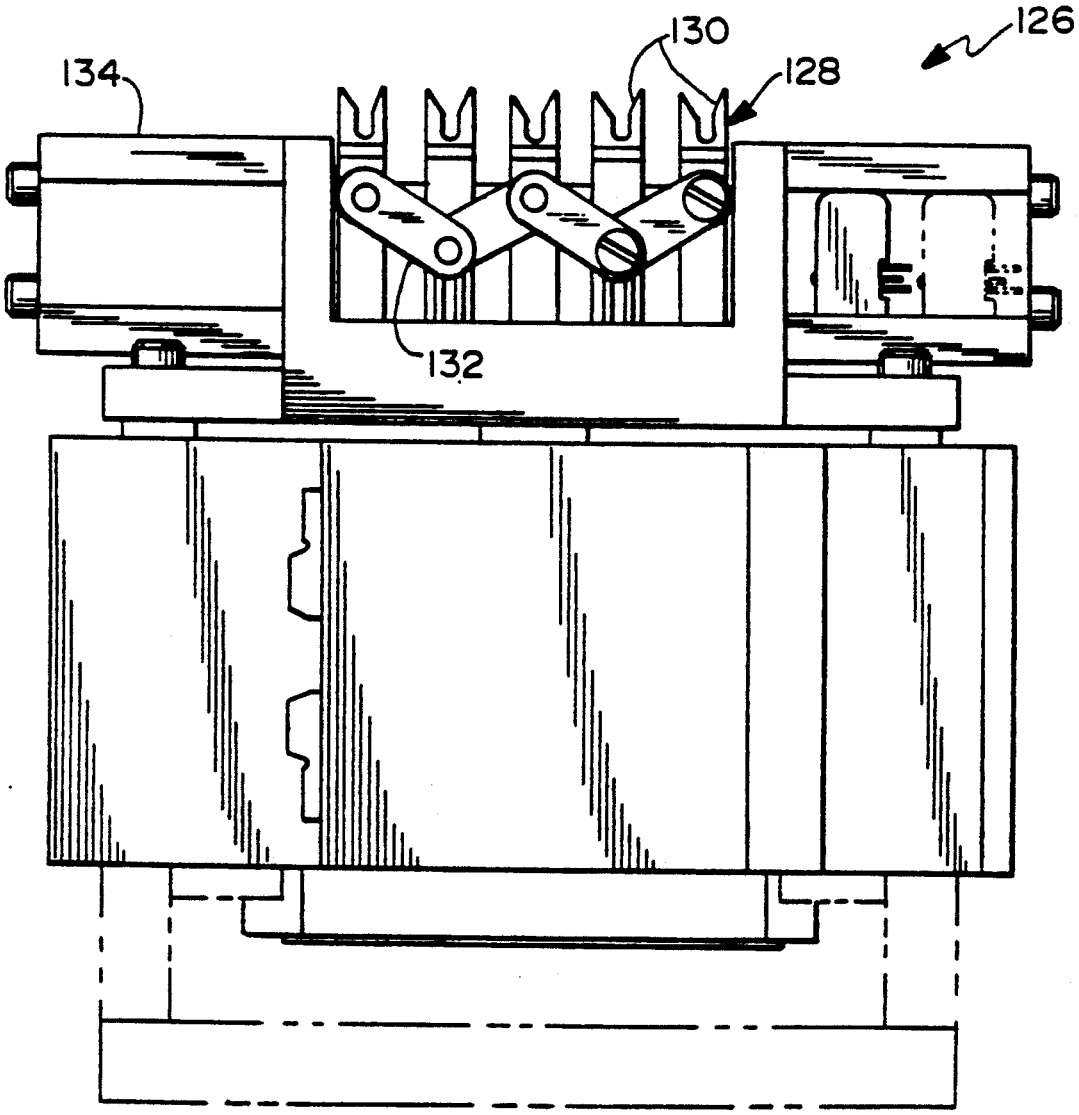

ELECTRICAL HARNESS ASSEMBLY APPARATUS

This is a divisional of copending application(s) Ser. No. 07/392,808 filed on Aug. 10, 1989.

BACKGROUND OF THE INVENTION

Lighting systems for buildings typically are wired in the field by electricians. The electrician typically will run a shielded multi-conductor cable, such as BX cable, from a central panel through conduits that may be mounted in suspended ceilings or walls of a building. The cables that extend from the central panel typically will lead to distribution boxes, from which the electrician will extend a plurality of separate cables to lighting units, switches or the like. The electrician working in the field will strip insulation from the various cable wires and manually complete the electrical connections at the central panel, the distribution boxes and the junction boxes. Although this standard prior art process is effective, it is extremely labor intensive.

Considerable manufacturing efficiencies have been achieved with respect to the stripping of insulation from wires, crimping terminals onto the wires and mounting terminated leads into electrical connector housings. In particular, the prior art includes many variations of apparatus and processes for making electrical harnesses for signal lines having a plurality of insulated conductors terminated at each respective end, with the terminals thereof mounted in associated housings. The available harness assembling equipment, however, generally is operative to repeatedly perform a plurality of substantially identical operations, with each terminal, each wire and each harness being identical.

Some known harness assembling equipment includes means for adjusting the crimp height to enable the harness assembling equipment to be changed over from making harnesses of a first dimension and/or type to making harnesses of a second dimension or type. Examples of this prior art include U.S. Pat. No. 4,587,725 which issued to Ogawa et al. on May 13, 1986; U.S. Pat. No. 4,790,173 which issued to Boutcher, Jr. on Dec. 13, 1988; U.S. Pat. No. 4,707,913 which issued to Moline on Nov. 24, 1987; and U.S. Pat. No. 4,400,873 which issued to Kindig et al. on Aug. 30, 1983. Each of these references shows apparatus for selectively adjusting the stroke of the crimp press. Another prior art terminating press is shown in U.S. Pat. No. 4,576,032 which issued to Maack et al. on Mar. 18, 1986 and which shows a crimp press having deflectable members to account for certain ranges of variations in the dimensions of a crimped terminal.

The prior art includes power wire harness assemblies that are intended to eliminate a substantial portion of the on-site wiring that typically is completed by electricians in the field. In particular, extremely effective power wire harness assemblies have been provided by Lithonia-Reloc of Conyers, Georgia. These assemblies include a shielded cable, such as BX cable, having a plurality of insulated conductors therein and having suitable electrical connectors securely mounted at opposed ends. The Reloc power wire harness assemblies can be extended from one junction box to another, from one cable to another or from a cable or junction box to a lighting fixture. Many power wire harnesses sold by Reloc include drop wires which extend from one of the two cable connectors of the power wire harness. The drop wire, with an associated connector mounted thereto, may be adapted to extend into a knockout on a lighting fixture.

The typical power wire harness assembly manufactured by Lithonia-Reloc will include drop wires extending from the cable connector only at one end of the cable. The cable connector having drop wires extending therefrom will be mated to a cable connector on another harness assembly that has no drop wires. Thus, a daisy chain of power wire harness assemblies may be created, with drop wires extending from one cable connector in each harness assembly, and from one cable connector in each mated pair of cable connectors.

The above described Reloc power wire harness assemblies substantially decrease the amount of on-site labor required by electricians. However, these prior art assemblies have not been well suited for the above referenced prior art automated harness assembling equipment. In particular, the terminations in each power wire harness assembly will vary significantly from one terminal to the next. For example, some terminations will require grounding clips, while others will not. Some terminals will include drop wires, while others will not. The drop wires may be 12 gauge solid wire, 18 gauge solid wire or 18 gauge stranded wire, with the particular selection of drop wires varying from one harness to the next. In most instances, the terminations at one end of the harness assembly will be significantly different from the terminations at the opposed end. In addition to the differences between the terminations on any single harness assembly, it is necessary to produce many different types of harness assemblies in accordance with the voltage and phasing requirements of the building's electrical system. For example, the gauge and number of conductors in the power cable may vary significantly from one harness assembly to the next. More particularly, the power cables are likely to include anywhere between three and five conductors per cable, with each conductor being either 12 or 18 gauge and being either solid or stranded. The length of the respective cables also will vary significantly from one harness assembly to the next. In view of these variables, the production of power wire harness assemblies has not been automated, and has merely moved the labor intensive assembling work from a largely uncontrolled field location to a more closely controlled factory location.

Attempts to improve the efficiency of the above described power wire harness assembling process is also rendered difficult by the high degree of quality control required for power wiring in buildings. Quality control often can be assured by visually inspecting the harnesses at various stages of their manual assembly. Automated harness assembling devices, however, make visual inspection during the manufacturing process more difficult. In many instances, the terminations produced by the prior art apparatus are substantially hidden from view when the completed harness is ejected from the prior art apparatus.

In view of the above, it is an object of the subject invention to provide an apparatus for more efficiently producing power wire harness assemblies.

It is a further object of the subject invention to provide a power wire harness assembling apparatus that can readily adjust to different termination requirements from one conductor to the next and from one harness assembly to the next.

A further object of the subject invention is to provide an apparatus and process for efficiently completing a power wire harness wherein selected terminals of the assembly have drop wires simultaneously terminated with selected cable wires.

Still another object of the subject invention is to provide a power wire harness assembling apparatus and process which substantially simultaneously checks the presence of terminals and guides the terminals into a housing.

An additional object of the subject invention is to provide a cable fixturing apparatus which places cable wires at a first pitch during trimming, stripping and terminating operations, but which establishes a second pitch for insertion into a housing.

SUMMARY OF THE INVENTION

The subject invention is directed to an apparatus and/or a system of apparatuses operatively connected to one another for assembling power wire harnesses. In particular, the subject invention may comprise conveying means for conveying a multi-conductor cable to a plurality of assembly or work stations at which the various conductors are prepared, terminated and inserted into a housing.

A conveying means of the subject invention may cooperate with pallets on which cables of preselected lengths may be coiled and fixtured. The conveying means may comprise means for selectively indexing the pallets to one or more work stations at which various harness assembling steps may be carried out. The system may include means for selectively permitting idling of the pallets while work is being performed at one or more downstream locations. The system may further include means for selectively disengaging pallets from the conveying means and maintaining disengaged pallets at fixed positions in proximity to one or more work stations of the system. Each pallet of the conveying means preferably comprises a pair of fixtures for rigidly fixturing each end of the cable, such that the respective conductors thereof are in controlled spaced relationship to one another, with the respective ends of the conductors being disposed for selected work to be carried out thereon. The fixtures may be operative to change the spacing between the conductors at selected work stations.

The system of the subject invention may comprise a work station with means for cutting and stripping drop wires to be terminated with selected conductors of the cable. This station may further comprise means for automatically placing the drop wires into selected wire receiving portions of the .fixtures on the pallets. The drop wires may be positioned in the fixtures prior to or after placement of the cable wires therein. The order in which the drop wires are placed in the fixtures may be selected to achieve the most efficient flow of pallets through the work stations of the system.

The system may further comprise one or more stations for trimming the cable wires to selected lengths, and/or for stripping selected lengths of insulation from the cable wires. The stripping preferably is carried out by cutting means which cuts through the insulation and subsequently pulls the insulation relative to a fixedly positioned pallet on which the cable wires are fixtured. The positioning of the drop wires relative to the cable wires can be either before or after the trimming and stripping of the cable wires as noted above. However, in embodiments where the drop wires are positioned first, it may be necessary to dispose the stripped end of the drop wire axially rearwardly of the end of the cable wire to prevent interference between the drop wire and the trimming and stripping means for the cable wire. In these latter embodiments, the station for stripping the cable wire may further comprise mens for pulling the end of the drop wire axially forwardly and into alignment with the stripped end of the cable wire.

The system of the subject invention may further comprise one or more stations for crimping terminals to the ends of the wires. The crimping station may be in proximity to means for feeding grounding clips to selected terminals in the power wire harness. The crimping station preferably is operative to sequentially crimp terminals to the conductors at each end of the power wire harness assembly. However, the sequential crimping may be carried out simultaneously at both ends of the harness assembly.

The crimping apparatus may comprise programmable means for selectively varying the crimp height for each sequential crimp as needed. In particular, the crimp height will be adjusted depending upon the gauge of wires to be terminated, the presence or absence of a grounding clip and the presence, absence and/or size of a drop wire. The adjustment of the crimp height may be carried out by at least one cam wedge means which may be linearly slidable relative to the crimping press to effectively alter the position of the head of the crimp press for both the conductor and the insulation at the completion of a crimping cycle. The crimp press also may be programmable to control the number of crimping operations carried out at each end of the harness assembly in accordance with the number of conductors that are present at a particular end of the harness assembly. More than one crimping station may be provided to achieve optimum flow of harness assemblies through the system. The crimping station may further comprise means for assessing the quality of the crimped termination for each terminal.

The system of the subject invention may further comprise a station for inserting the terminated wires of the cable into housings. In particular, housings may be sequentially fed into proximity to the fixtured ends of the cables. Means also may be provided for urging the terminated wires into a center-to-center spacing corresponding to the pitch required for the connector. The mounting of the terminals into the housings preferably is carried out with guide means for ensuring that the terminals are urged into the respective housings without potentially damaging contact between the terminals and the housings as part of the insertion process. The guide means may comprise probes that are directed through terminal receiving apertures in the housing and which subsequently engage the terminals. The probes may define either pins for engaging pin receiving terminals on a harness assembly or concave structures for engaging pin terminals, blades or other such male terminal means on the harness. The housing and the terminals may be moved relative to one another after the probes have properly engaged the terminals, to enable the probes to guide the terminals into the housing.

The probes may comprise portions of test assemblies which test for the presence of terminals. The test assembly may be programmable to test for the presence of the specified number of terminals for the particular harness assembly. The absence of a specified terminal will be sensed by the probes and may generate a signal to identify an unacceptable harness assembly.

The completed harness assembly may advance to other stations for mounting shells over the connector housing. These other stations on the system may be employed to test the completed harness assemblies, mount connectors to the drop wires and/or prepare the completed harnesses for shipment or storage.

BRIEF DESCRIPTION OF THE DRAWINGS

FIG. 9 is a front elevational view of an alternate wire gathering assembly at the housing insertion station.

DETAILED DESCRIPTION OF THE PREFERRED EMBODIMENT

Figure 1:
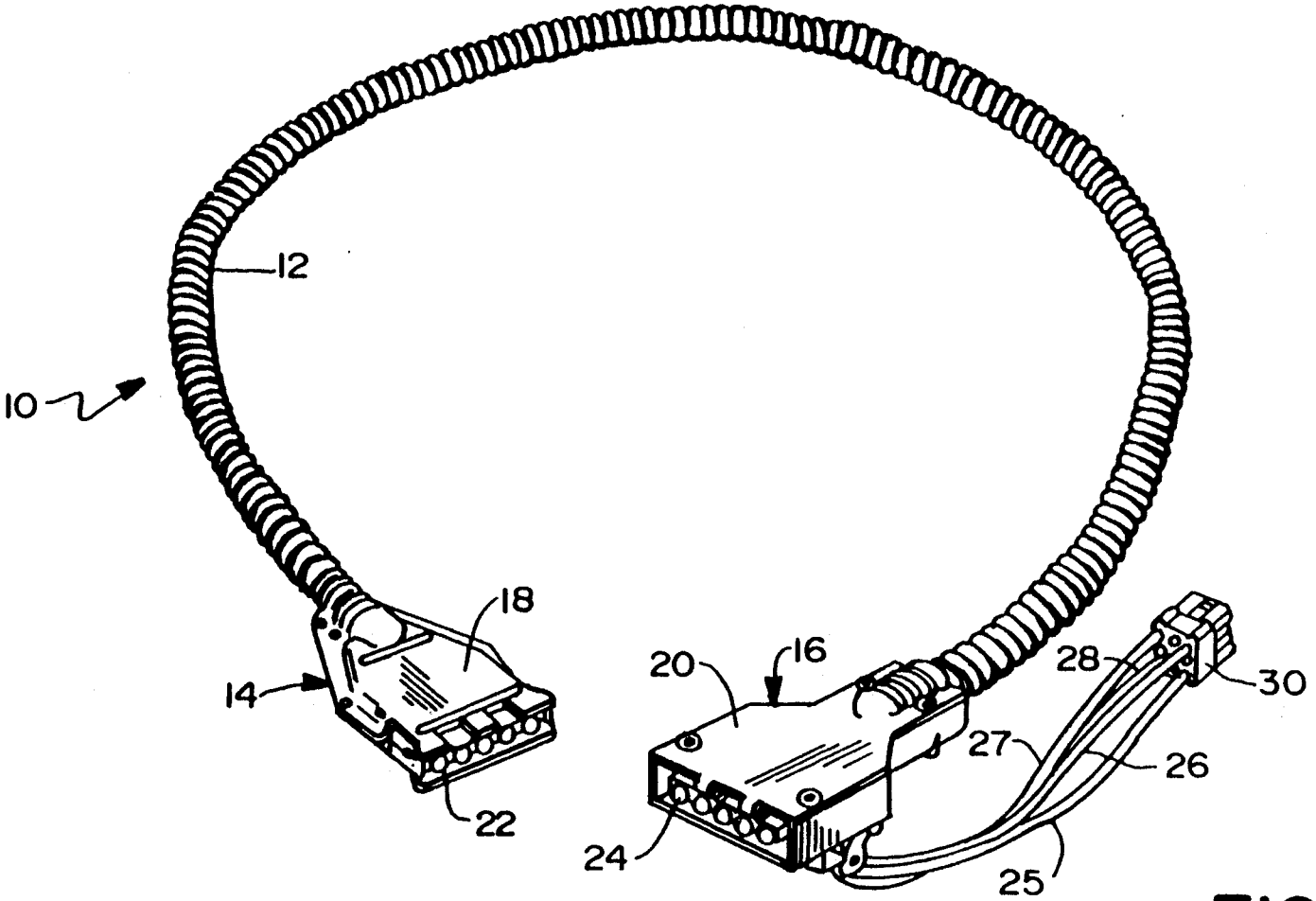
FIG. 1 (PRIOR ART)
FIG. 1 is a perspective view of a prior art power wire harness assembly that is manufacturable by the system of the subject invention.

The system of the subject invention is operative to efficiently produce a prior art power wire harness as indicated generally by the numeral 10 in FIG. 1, which may be one of the harness assemblies of the type manufactured by Lithonia-Reloc. The power wire harness 10 depicted in FIG. 1 is intended for interior applications, such as the fluorescent lighting widely employed in the suspended ceilings of commercial, office or light industrial buildings. It is to be understood, however, that many other applications for the power wire harness 10 exist.

The power wire harness 10 comprises a cable 12, which may define a BX type of cable having a flexible outer metal shield. As depicted in FIG. 1, the cable 12 defines a relatively short length. It is to be understood, however, that the length of the cable 12 is subject to great variation depending upon the specifications established for the end use of the power wire harness 10. The cable 12 of the harness 10 includes a plurality of separately insulated conductors or cable wires (not shown) therein. The number and the cross sectional dimension or gauge of the separate cable wires may vary significantly from one power wire harness 10 to another. For example, the cable 12 may comprise a total of four cable wires therein, which are intended to define two hot wires, one neutral wire and one ground on the completed harness 10. Other cables, however, may have only three cable wires, while others may have five. The particular number of cable wires within the cable 12 will depend upon voltage, phasing and other system parameters.

The power wire harness assembly 10 further comprises connectors 14 and 16 mounted respectively to the opposed ends of the cable 12. The connectors 14 and 16 include electrically conductive terminals (not shown) mounted therein and corresponding in number to the number of cable wires in the cable 12. The connectors 14 and 16 are defined by outer metallic shells 18 and 20 respectively that are mechanically joined to the cable 12. The connectors 14 and 16 further include non-conductive molded housings 22 and 24 respectively in which the terminals (not shown) are mounted.

The connector 16 includes drop wires 25–28 extending therefrom. The drop wires 25–28 are terminated with the cable wires (not shown) to the respective terminals (not shown) within the connector 16. The drop wires 25–28 are terminated to a fixture connector 30 which can be snapped into engagement with a knock-out aperture in a lighting fixture for subsequent pluggable electrical connection to a corresponding connector on a lighting fixture. It will be noted that the connector 14 does not include a corresponding array of drop wires.

A plurality of power wire harnesses 10 of selected lengths may be employed in daisy chain fashion by electrically joining the harnesses 10 in end-to-end relationship. Thus, the connector 14 of one power wire harness 10 will be mated with a connector 16 on a second power wire harness 10. The connections between power wire harnesses will be made in proximity to the knock-out apertures in the lighting fixtures, such that the drop wires 25–28 can be directed toward the lighting fixture. The fixture connector 30 then can be snapped into engagement with the knock-out aperture in the lighting fixture.

It is to be understood that many of the power wire harnesses manufactured by the system and process of the subject invention will be similar to the harness 10 shown in FIG. 1, but will not include the drop wires 25–28. These harnesses will be used substantially like extension cords, and will minimize inventory problems of the specifically configured harnesses 10 having drop wires 25–28 extending therefrom. It also should be emphasized that the harnesses 10 are subject to many other variations as noted above. In particular, the specifications of the drop wires may vary considerably as to the number of wires, the gauge of the wires, and whether the wires are stranded or solid. The number and gauges of cable wires also can vary. Additionally, certain of the cable wires will be terminated with grounding clips, while others will not.

Figure 2:
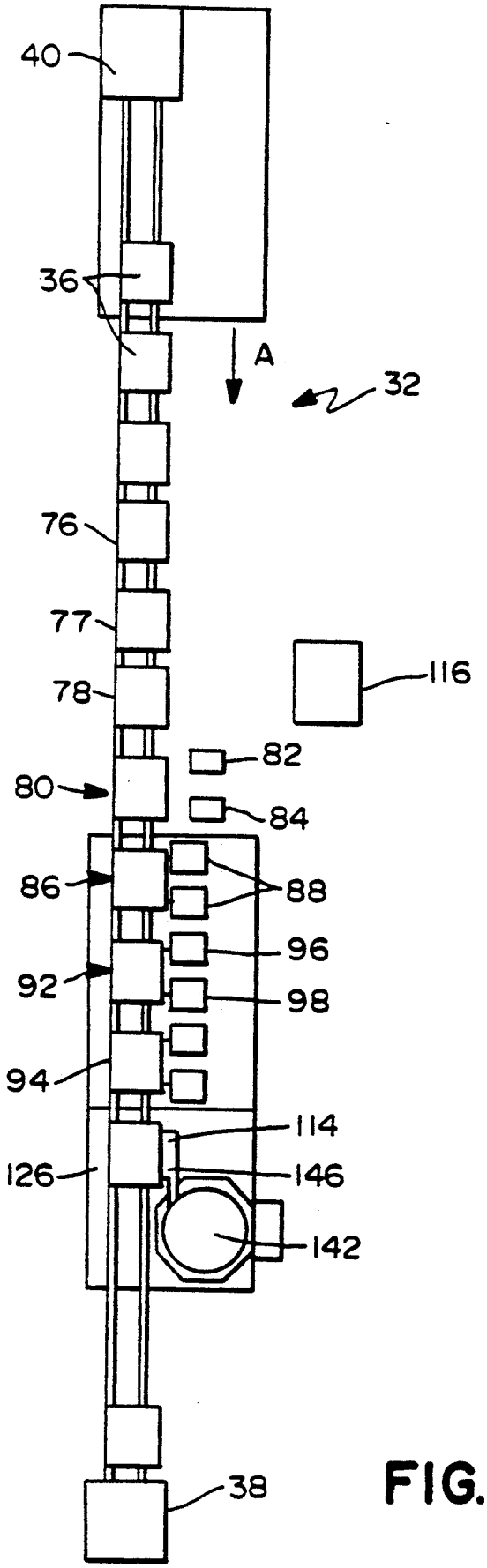
FIG. 2 is a schematic view of the system of the subject invention.

The system for forming the power wire harnesses 10 is illustrated schematically in FIG. 2, and is identified generally by the numeral 32. The system 32 includes a chain track 34 along which pallets 36 are movable. The portion of the chain track 34 illustrated in FIG. 2 is operative to move the pallets 36 linearly in a direction indicated by arrow "A". The system 32 further comprises a down elevator 38 and an up elevator 40 which define the extreme ends of the system 32. The system 32 further comprises a lower chain track (not shown) which also connects the down elevator 38 and the up elevator 40 but which is operative to travel in a direction opposite the direction indicated by arrow "A". It is to be understood, however, that the system 32 may define a loop disposed at a single elevation and without the elevators 38 and 40.

Figure 3:
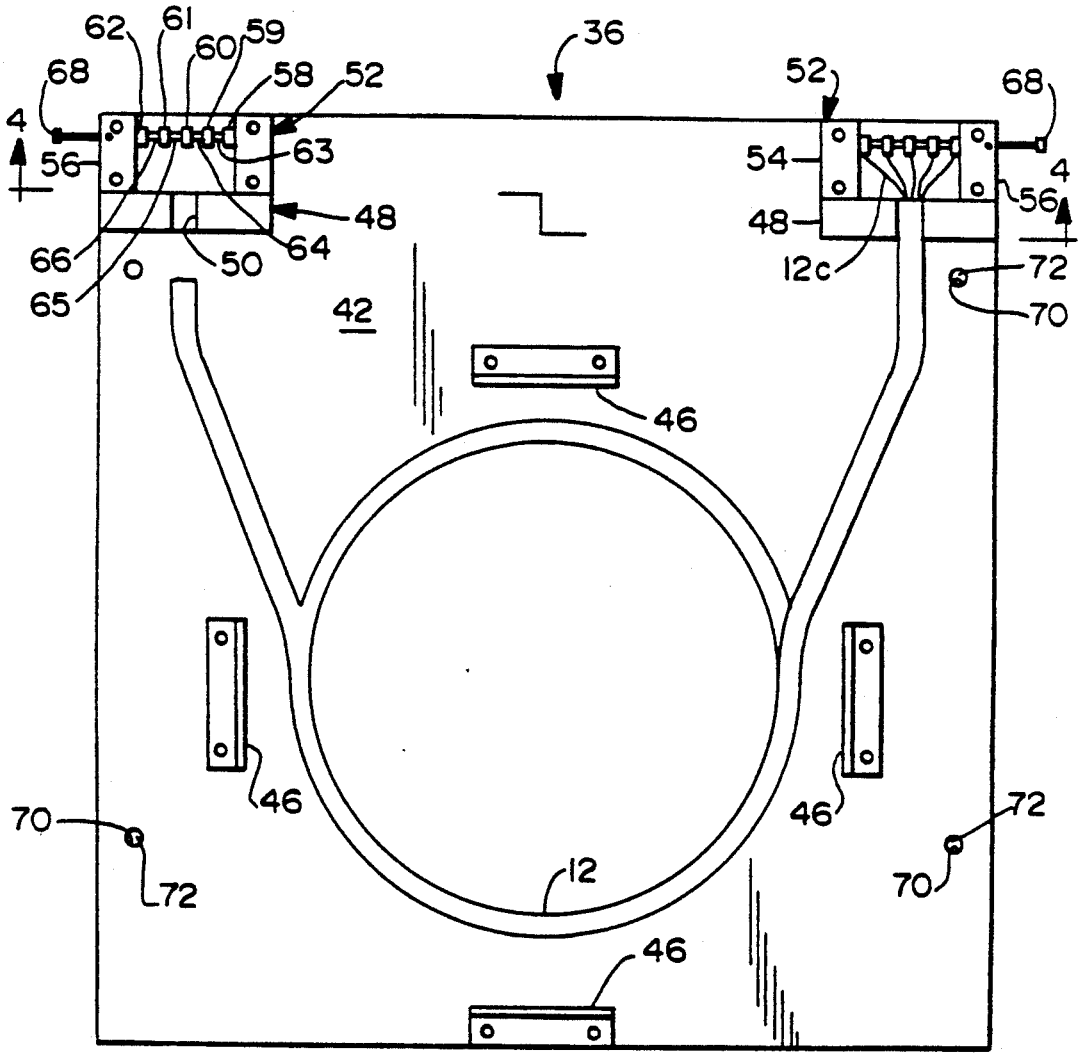
FIG. 3 is a top plan view of a pallet for use in the system of the subject invention.
Figure 4:
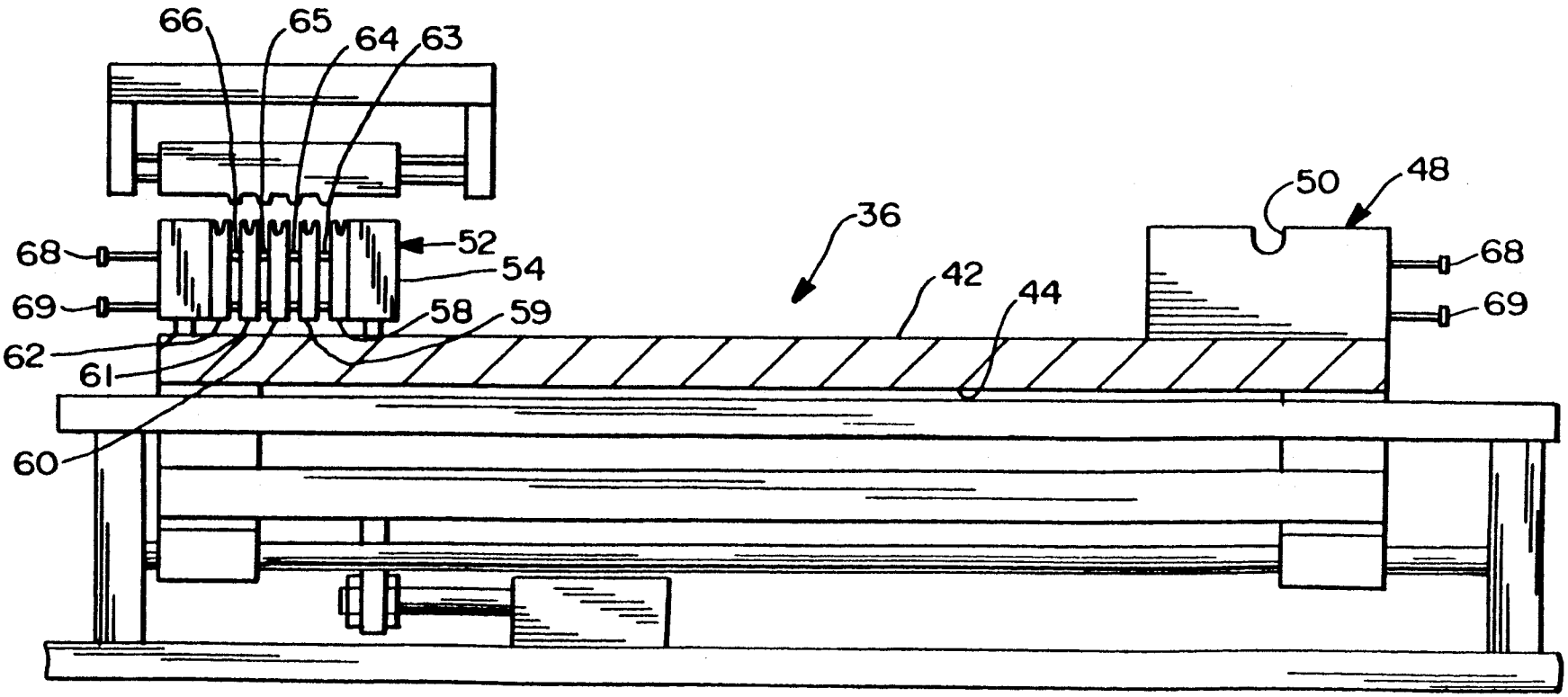
FIG. 4 is a front elevational view of a pallet in proximity to a crimper of the subject system.

A pallet 36 is illustrated in greater detail in FIGS. 3 and 4. More particularly, the pallet 36 is a generally rectangular planar structure having a top surface 42 and an opposed bottom surface 44. The top surface 42 of the pallet 36 includes a plurality of cable guides 46 rigidly mounted thereto in spaced relationship to one another. The cable guides 46 enable a coil of cable 12 to be securely retained on the pallet 36, as shown in FIG. 3.

The pallet 36 further comprises a pair of cable support brackets 48 having generally semi-cylindrical grooves 50 formed therein for receiving portions of the cable 12 adjacent the ends of the metallic shield thereon. The cable support brackets may optionally be provided with clamping means for securely, but releasably, retaining the cables therein.

Wire holder assemblies 52 are mounted to the top surface 42 of the pallet 36 adjacent the cable support brackets 48. This particular embodiment of each wire holder assembly 52 comprises a pair of end supports 54 and 56 which are mounted to the top surface 42 of the pallet 36 in spaced relationship to one another. A plurality of wire guides 58–62 are disposed intermediate the supports 54 and 56 respectively. The wire guides 58–62 each include a notch in the top portion thereof dimensioned to engage one of the cable wires and to additionally engage one of the drop wires if required. The wire guide 58 is rigidly mounted to the end support 54. However, spring assemblies 63–66 are sequentially disposed intermediate adjacent wire guides 58–62 as shown in FIG. 3. Thus, the wire guides 59–62 can be collapsed relative to one another and urged respectively toward the wire guide 58. However, the forces exerted by the springs 63–66 will urge the wire guides into a fully extended position relative to one another such that the wire guide 62 is adjacent to the support 56.

The wire holder assembly 52 further comprises core pins 68 and 69 which extend slidably through the support 56 and are attached to the wire guide 62. Thus, a force exerted on the core pins 68 and 69 will overcome the forces exerted by springs 63–66 and cause the wire guides 59–62 to be urged toward one another and toward the wire guide 58. In their extended condition, as shown in FIG. 3, the wire guides 58–62 define center to center spacings of approximately 0.588 inch. However, in their collapsed condition the wire guides 58–62 define center to center spacings of only about 0.316 inch which corresponds to the pitch of the housing as explained below. Thus, the wire guides 58–62 define a major pitch between the wires in an expanded condition of the fixture 52 and a minor pitch between the wires in an expanded condition of the fixture 52 and a minor pitch in a contracted position. Other selected center to center spacings in the expanded and collapsed conditions of the wire holder assembly 52 may, of course, be provided depending upon the requirements of the system. The object of the selective expansion and contraction of the wire holder assembly is to provide adequate room for trimming, stripping and crimping operations in the expanded condition, and also to enable efficient insertion of the terminated wires into closely spaced apertures in a housing.

An equally efficient but substantially less expensive alternative to the above described wire hold assemblies 52 is to provide a rigid wire holder assembly with fixed wire guides disposed at a center-to-center spacing of 0.588 inch, or other appropriate spacing for the terminals being employed. An appropriate downstream station may then be provided to remove wires from the wire guides and to collapse the wires to a closer spacing for insertion into a housing as explained and illustrated below.

The pallet 36 further includes a plurality of shot pin holes 70 which are engageable by shot pins 72 to lift the pallet 36 from the chain track 34 at selected work stations as shown in FIG. 3, and as explained further below.

Returning to FIG. 2, the pallets 36 of the system 32 are movable along the chain track 34 to a plurality of different work stations. The first station is a cable load station 76. A technician may be disposed at location 76 to manually load coils of cable 12 onto the pallet 36 positioned at station 76. The cable 12 typically will be coiled to define a diameter of approximately 15 inches with lengths of cable extending between 2 inches and 12 inches beyond the tangent point of the coil. The cable 12 will be pre-cut to a selected length and will have selected lengths of cable wires extending from the respective opposed ends of the shielding.

Stations 77 and 78 are located downstream of the cable load station 76 and define stations for fixturing the cable wires within the wire holder assemblies 52. The stations 77 and 78 may be operated by one or more technicians depending upon the cycle times required for the system 32. For example, station 77 may be employed to position and fixture the cable wires at the first end of the cable 12, while station 78 may be employed to position and fixture wires at the opposed second end of the cable 12. The cable wires are mounted in the wire holder assemblies 52 in an unstripped condition. Additionally, in some operations, drop wires may be positioned manually in the fixtures immediately prior to the manual placement of the cable wires. Any drop wires that may be positioned at this station will be stripped and may have terminals attached to the trailing end. The drop wires will be positioned in the fixtures first and the cable wires will then be positioned with their unstripped ends axially forwardly relative to the ends of the precisely positioned drop wires. It should be noted that most drop wires will be automatically positioned at a down stream station as explained herein. Manual placement of drop wires will only be employed to achieve optimum cycle time in some situations.

A trim and strip station 80 is disposed downstream from the cable wire fixturing stations 77 and 78. The trim and strip station 80 is initially operative to simultaneously trim the cable wires to specified lengths, such that the trimmed ends of the cable wires are at specified distances forward of the fixtures and the ends of any previously positioned drop wires. The station 80 subsequently is operative to strip a selected amount of insulation from each cable wire. As shown in FIG. 2, the trim and strip station 80 includes first and second trimming and stripping devices 82 and 84 for the respective first and second ends of each cable 12. The trimming and stripping devices 82 and 84 are operative to simultaneously cut all wires on a pallet 36 and then to simultaneously strip all wires on the opposed first and second ends of the cable 12. The trimming and stripping devices 82 and 84 are operative to move relative to the pallet 36 for pulling the insulation from the conductor of each cable wire 12. This pulling movement of the trimming and stripping devices 82 and 84 also is operative to grip any drop wire that may be present and pull it forwardly to be aligned with the trimmed end of the cable wire.

The drop wire station 86 is operative to programmably pay-out specified lengths of a selected drop wire, which may be 12 gauge solid wire, 18 gauge solid wire or 18 gauge stranded wire. The leading end of the length of drop wire is appropriately stripped and is programmably placed in a selected wire guide 58–62 of the wire holder assembly 52. The opposed end of each drop wire may be stripped, partially stripped or unstripped depending upon the particular connection to be made with the drop wires. As noted above, not all harness assemblies produced by the system 32 will require drop wires. In situations where drop wires are not required, the station 86 will merely define a test station.

Figure 5:
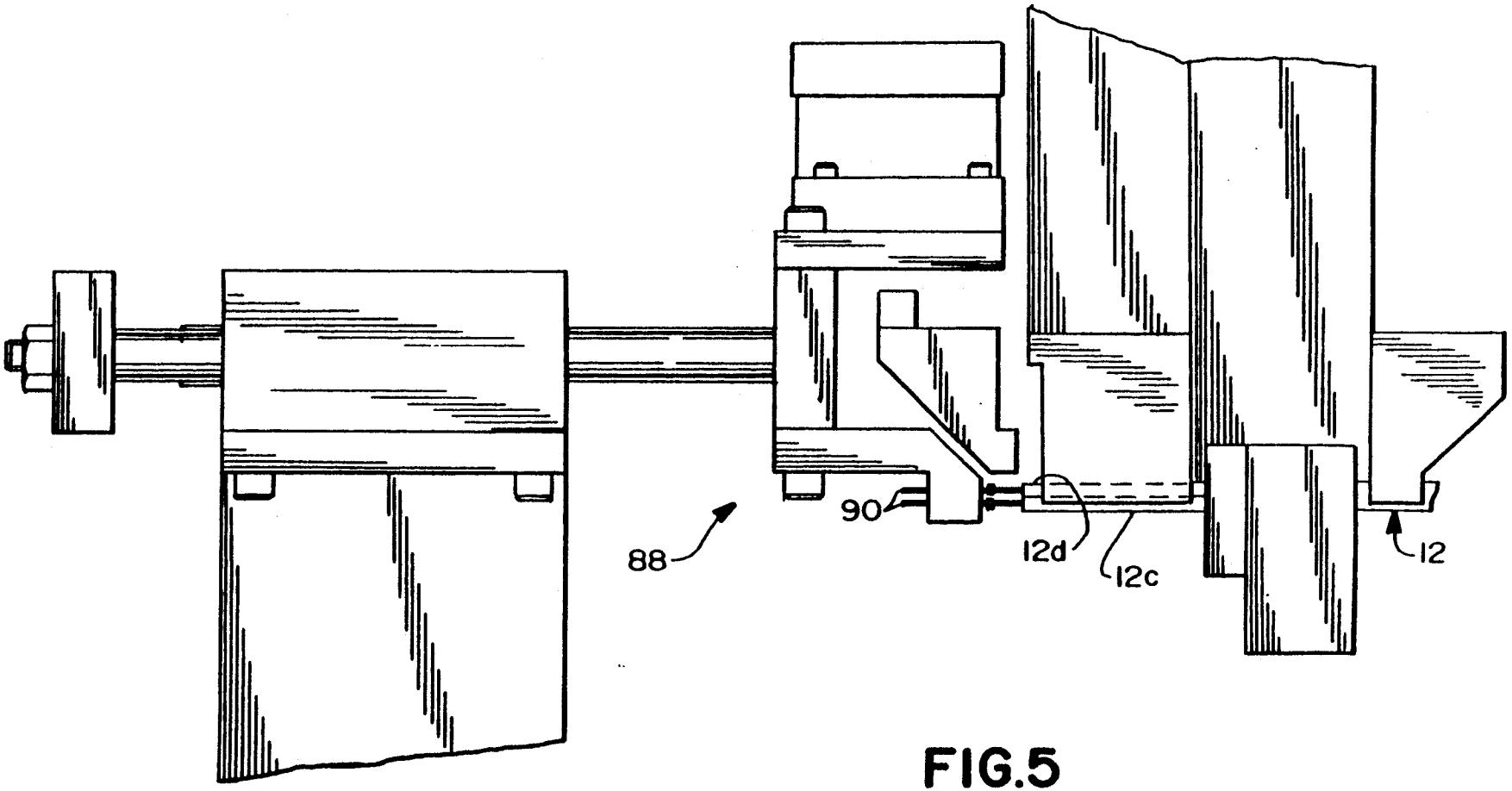
FIG. 5 is a side elevational view of the wire continuity and position sensor assembly of the subject system.
Figure 6:
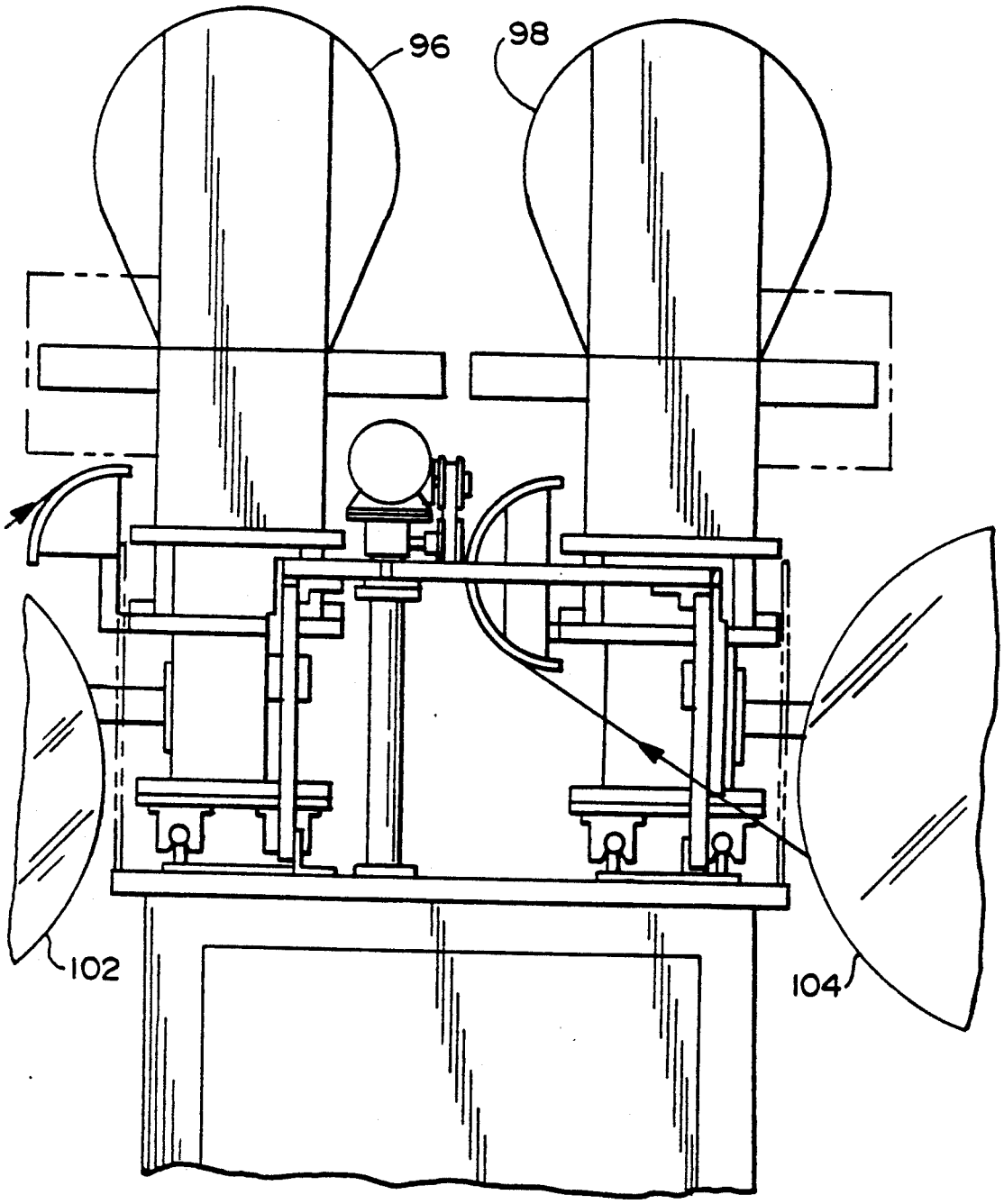
FIG. 6 is a front elevational view of the crimp station of the subject system.

The drop wire station 86 includes testers 88 as shown in FIG. 5. Each tester 88 includes probes 90 which are disposed to be axially in line with any cable wires 12*c* or drop wires 12*d* that may be present. The probes 90 are operative to move axially forward to contact the ends of the conductors that may be present, and to test for the presence of each conductor that should be present, to test for proper position of the conductor and to test for continuity between opposed ends of each cable wire 12*c*. A failure of any test will generate a signal to identify the particular pallet for a special treatment which may vary depending upon the particular sensed condition. In some instances, the cable 12 will have to be scrapped, while in other instances appropriate corrective action may be employed, such as realigning the stripped end of a wire or positioning a drop wire.

Crimp stations 92 and 94 are disposed downstream from the drop wire station 86. The provision of two crimping stations 92 and 94 is intended to provide the most efficient cycle time and to avoid down time for maintenance. As explained herein, the crimp station 92 may be operative to crimp terminals to three cable wires. The crimp station 94 normally will be operative only in situations where the cable 12 has more than three cable wires, and normally will be operative to crimp terminals to the cable wires in excess of three. The crimp stations 92 and 94 are otherwise identical, except for the particular cable wires and terminals being crimped, and each is operative to crimp as many as five wires. Thus one crimp station 92 or 94 may be used for all crimps when the other station is down for repair or tool replacement.

The crimp station 92 as shown in FIGS. 2 and 6–8 includes first and second crimping presses 96 and 98 and a ground clip feed bowl 100 which is operative to feed ground clips (not shown) to the wire guides prior to crimping. The first and second crimp press 96 and 98 each are operative to sequentially crimp terminals fed from reels 102 and 104 to both the conductor and insulator of wires 12*c*, 12*d* at the respective first and second ends of the cable 12. The pallet 36 disposed at the crimp station 92 is indexed incrementally between sequential cycles of the crimp presses 96 and 98 by the servo feed motor shown schematically in FIG. 7 and identified generally by the numeral 106 in FIG. 7. Thus, the crimp presses 96 and 98 will simultaneously crimp a terminal to a first cable wire 12*c* plus any drop wire 12*d* or ground clip that may be present in the cable 12. The pallet 36 will then index approximately 0.588 inch and the first and second crimp presses 96 and 98 will crimp terminals to second cable wires in the cable 12 plus any drop wire or ground clip that may be present. This cycle will repeat at least a third time after which the pallet 36 may be advanced to a downstream station for either additional terminal crimping operations or for insertion of the terminated wires into the housing as explained below.

Figure 7:
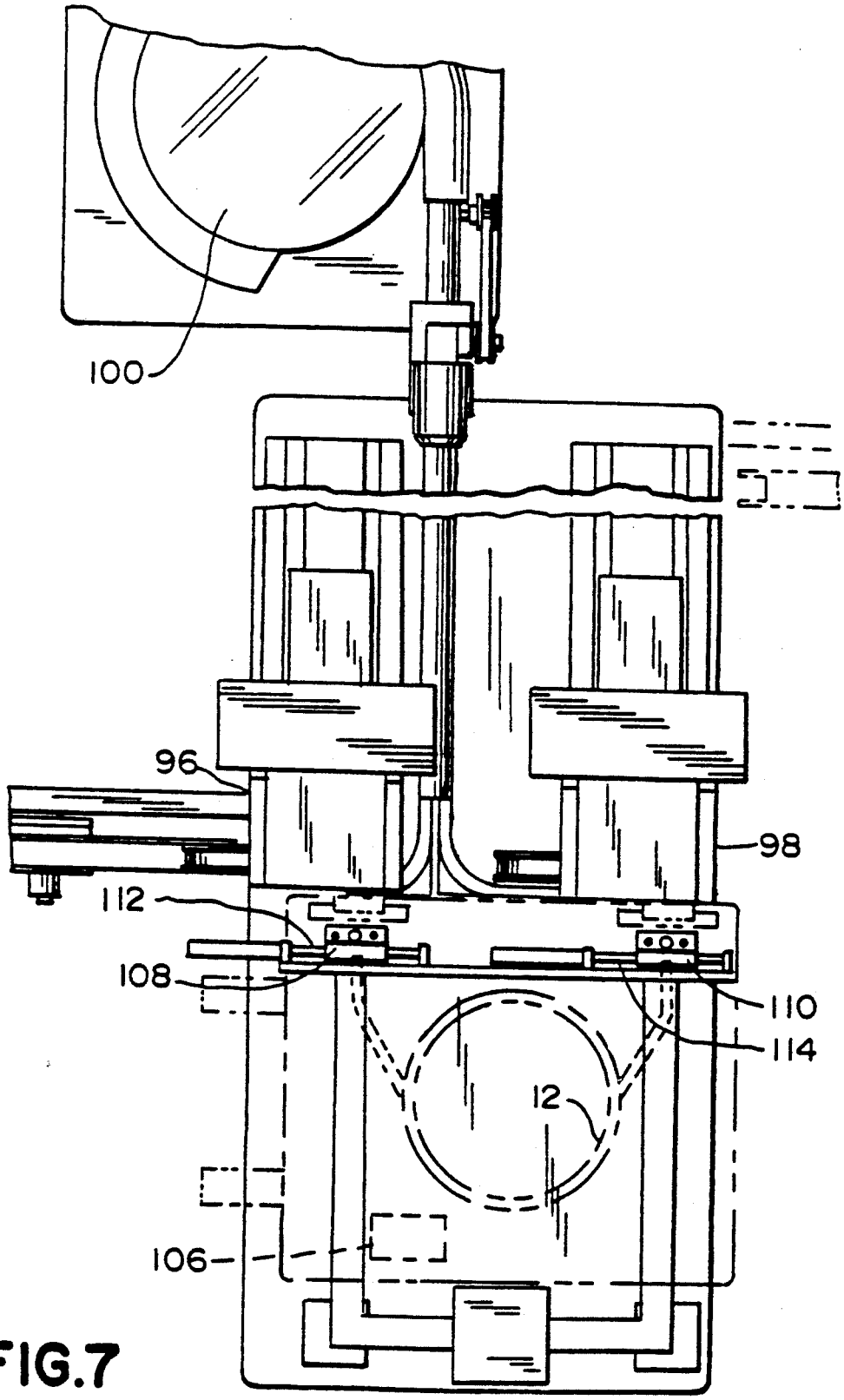
FIG. 7 is a top plan view of a pallet at the crimp station.
Figure 8:
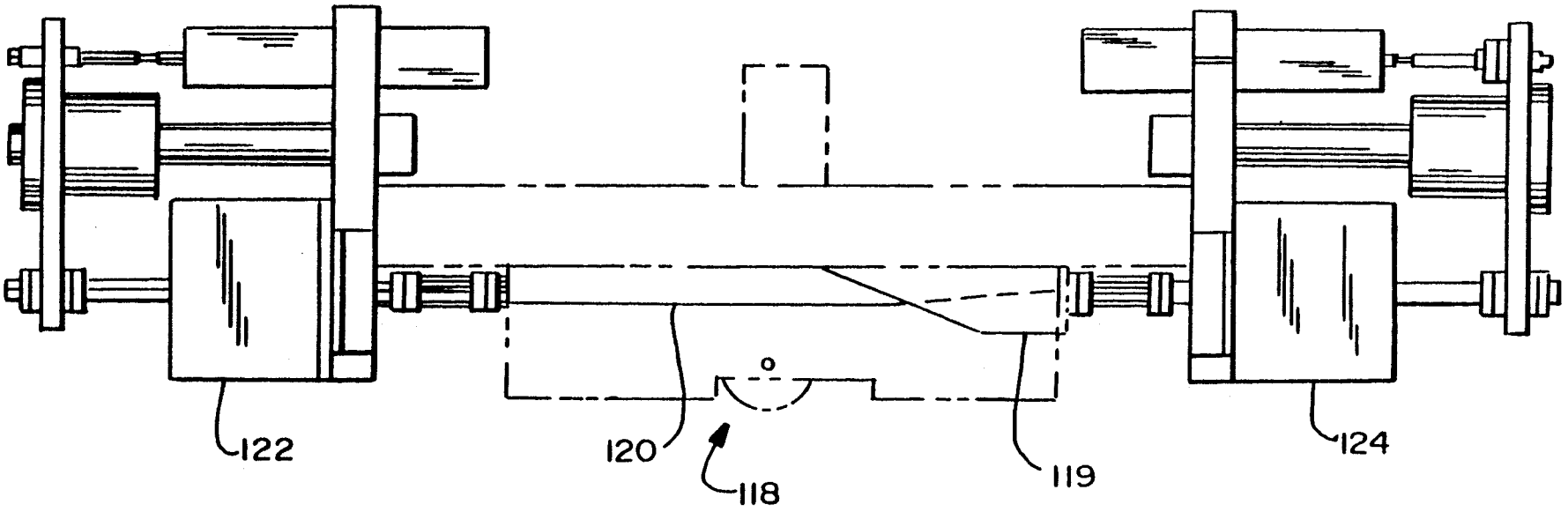
FIG. 8 is a front elevational view of the crimp adjustment apparatus.

The crimping presses 96 and 98 comprise wire locators 108 and 110 respectively which are slidably mounted on support rods 112 and 114 as shown in FIG. 7. The wire guide locators 108 and 110 are urged downwardly as part of an initial movement of the crimp press 96, 98 to securely retain the wires and ground clips in the wire guides 58–62. The wire guide locators 108 and 110 will slide along the rods 112 and 114 with the indexing of the pallet 36 by servo motor 106 between sequential cycles of the crimp presses 96 and 98.

As noted above, the terminations will vary significantly from one terminal to the next, depending upon the gauge and type of any drop wire that may be present, and the presence or absence of grounding clips. The system of the subject invention includes a programmable controller, indicated schematically by the numeral 116 in FIG. 2, into which control data as to the number and gauges of cable wires 12*c*, the presence, absence, type and location of drop wires 12*d* and the location of grounding clips may be entered. U.S. Pat. No. 3,964,147 issued Jun. 22, 1976, assigned to the present assignee and entitled Connector Assembly Machine, discloses an automated harness assembly machine including an electrical control circuit and a pneumatic control circuit adapted for controlling sequential functions and operations of the various machine components. Automated operations by the system 32 illustrated in FIG. 2 are controlled by the programmable controller 116 that can include electrical and pneumatic control circuits of the type disclosed by U.S. Pat. No. 3,964,147. The disclosure of U.S. Pat. No. 3,964,147 is incorporated herein by reference. The crimping presses 96 and 98 comprise crimp height controllers 118 as shown most clearly in FIG. 8, which are operatively connected to the programmable controller 116 in which these control data are entered. The controller 116 is operatively connected to the terminating stations 92 and 94 for identifying an optimum crimp height for each termination. In this manner, the crimp presses 96 and 98 are operative to perform an optimum crimp on the particular arrangement of wires and grounding clips being presented thereto. More particularly, the crimp height controllers 118 each comprise cam wedges 119 and 120 which are slidably movable in opposed respective linear directions orthogonal to the crimping direction of the crimp presses and under the action of stepper motors 122 and 1.24. The controlled sliding movement of the cam wedges 119 and 120 determine the maximum crimp height stroke enabled by the crimp press for the conductor crimp and insulation crimp respectively. Thus, the crimp height controller 118 are operative to achieve an optimum crimp height and pull out force for each particular crimp, depending upon the programmed characteristics of the wires and/or grounding clips being terminated.

Figure 10:
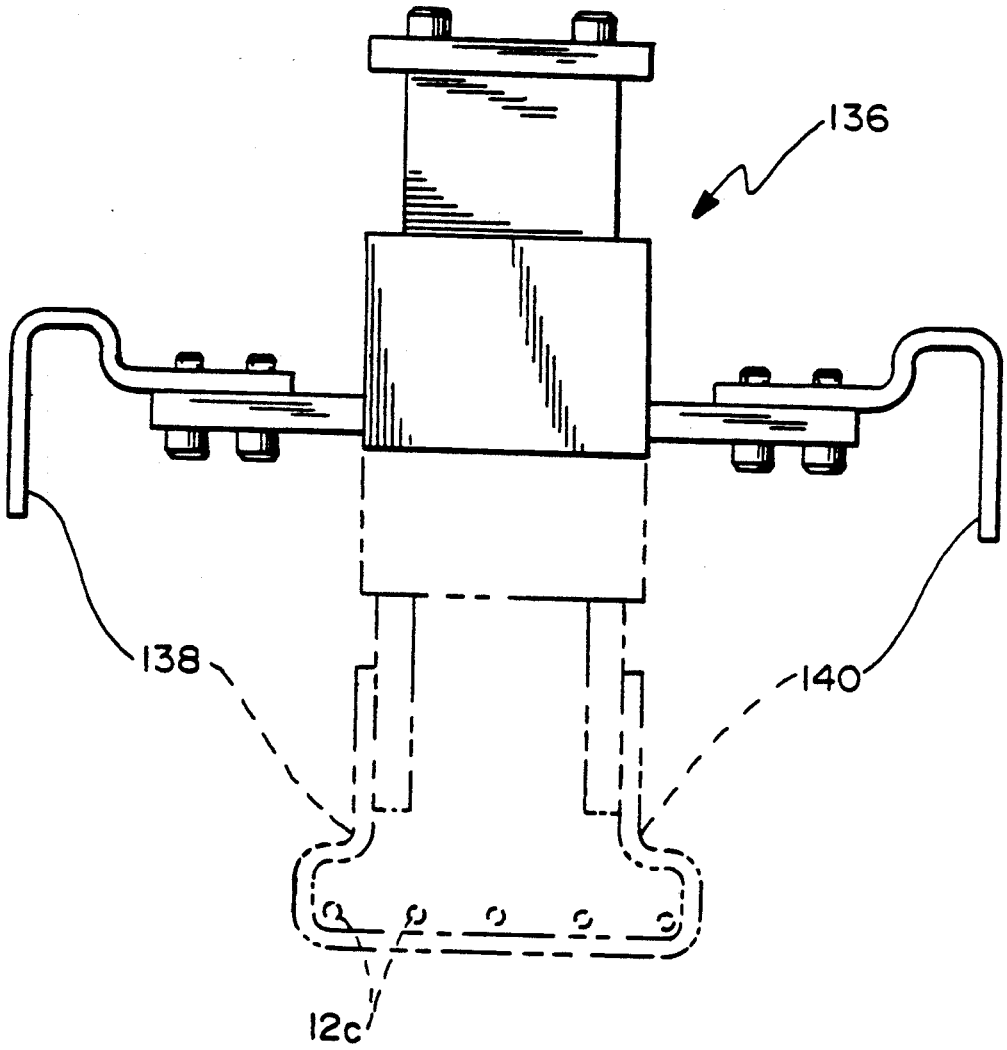
FIG. 10 is a front elevational view of a wire lifter assembly for use with the wire gathering assembly.

After the termination has been completed, the pallet 36 advances downstream to the insertion station 126 as shown in FIG. 2. The movement of the pallet 36 into the insertion station 126 causes the core pins 68, 69 of the wire holder assemblies 52 to be engaged, and thereby collapsing the wire guides 58–62 toward one another. Alternatively, a pallet without collapsible wire holder assemblies may be provided. In this embodiment, as shown in FIG. 9, the insertion station 126 includes a collapsible fixture assembly 128 with separate notched fixtures 130 for engaging the terminated wires. The notched fixtures 130 are connected by pantograph linkage members 132 and are powered by air cylinder 134 to selectively collapse the wires to a 0.316 inch spacing. The insertion station 126 further includes a wire gripper and lifter assembly 136, as shown in FIG. 10, with selectively rotatable arms 138 and 140 for lifting and gathering the wires 12*c* into a spacing consistent with the collapsed condition of the fixture assembly 128. The collapsible fixture assembly 128 and the wire gripper and lifter assembly 136 are operative to lift the ends of the cable 12 from the fixture on the pallet and then to effect the collapsing.

Figure 11:
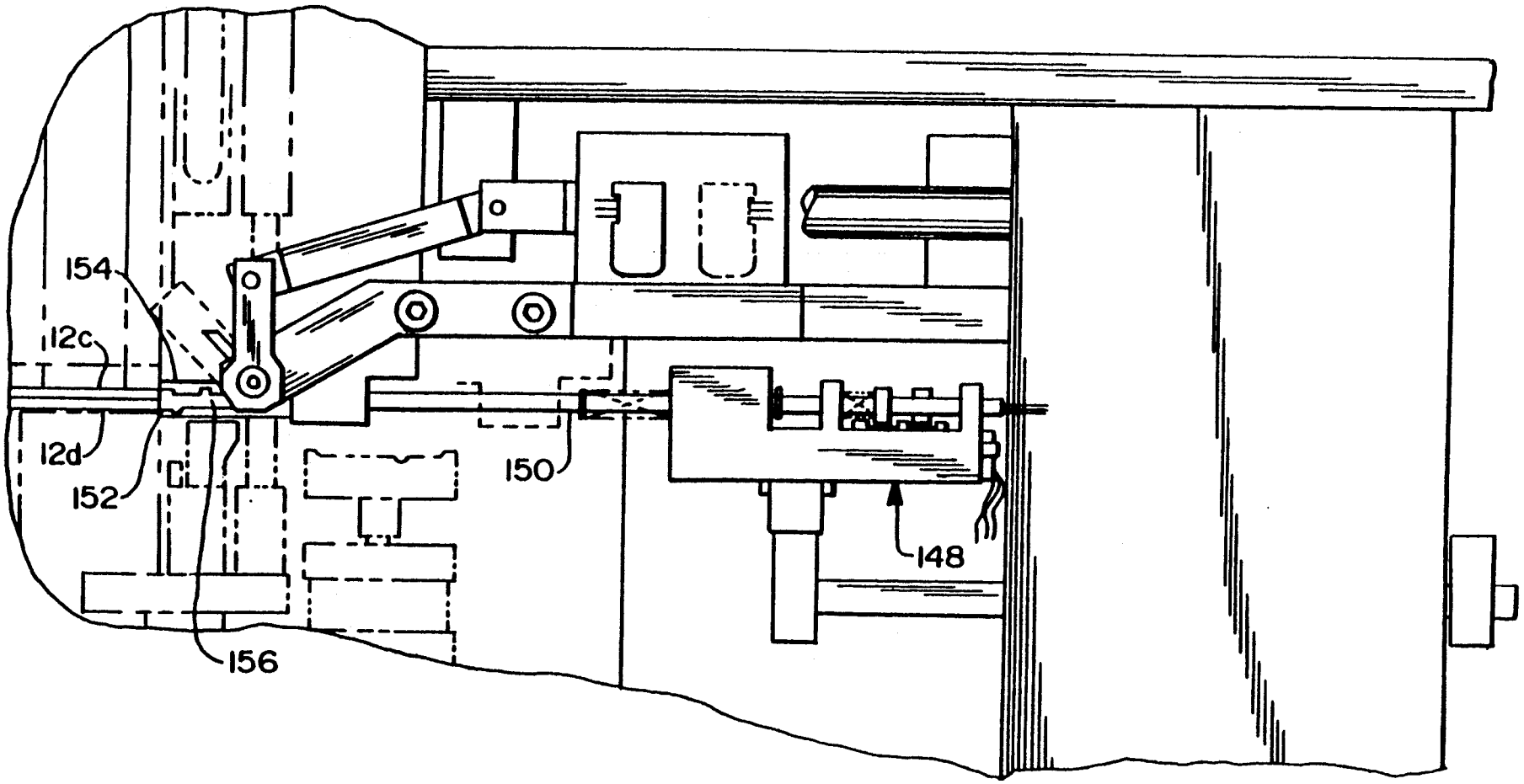
FIG. 11 is a side elevational view of the housing insertion station.

Referring also to FIG. 11, the insertion station 126 includes a dual track bowl feed and supply hopper 142, as shown generally in FIG. 2, from which molded plastic housings are fed into first and second positions 144 and 146 adjacent the opposed first and second ends of the cable 12. The first and second positions 144 and 146 of the insertion station 126 are in proximity to movable probe assemblies 148 as shown in FIG. 11, which have a plurality of probes 150 corresponding in number to the maximum number of cable wires 12*c*. Additionally, the spacing between the probes corresponding to the spacing between terminal receiving apertures 152 in the housings 154. The probe assemblies 148 advance toward the housing 154 such that the respective probes 150 pass through the corresponding terminal receiving apertures 152 in the housings 154. Additionally, the movement of the probe assemblies 148 causes the respective probes 150 to contact and engage the terminals 156 crimped to the ends of the respective wires 12*c*, 12*d*.

The probes 150 are operatively connected to known test circuitry such that the presence of a terminal 156 can be sensed and, if desired, such that the continuity of a cable wire 12*c* can be sensed. A cable 12 will be identified for rejection if a required terminal is not sensed as being present, or if the probe assemblies 148 fail to accurately sense the necessary continuity along the length of the cable wires 12*c*. On the other hand, once the probe assemblies 148 have sensed an acceptable product, a housing moving fixture 145 at the insertion station 126 is operative to move the housings 154 relative to the terminals 156 and the probe assemblies 148. This is carried out by moving the housing moving fixture 145 from its housing load position, shown in phantom at 145*a*, to its housing insertion positions shown in FIG. 11. The probe assemblies 148 are thus operative to guide the respective terminals 156 into the terminal receiving cavities 152 of the housing 154, while simultaneously ensuring that inadvertent and potentially damaging contact between the leading ends of the terminals 156 and the walls of the housing 154 is avoided. Upon complete movement of the housings 154 over the terminals 156, the probe assemblies 148 are retracted and the pallet 36 is advanced to an unload station at which the completed harness assembly is unloaded. The movement of the probes 150 and housings 154 can be carried out by various conventional actuator arrangements, for example, such as by pneumatic cylinders associated with the movable probe assemblies 148 and the housing moving fixture 145. Selective pressurization of pneumatic cylinders for controlling movement is disclosed by the above-mentioned U.S. Pat. No. 3,964,147. The pallet 36 is then advanced toward the down elevator for recycling in the system. In optional embodiments (not shown), the pallet 36 may advance to locations at which a metallic shell is mechanically engaged around the housing and the jacket of the cable.

While the invention has been described with respect to certain preferred embodiments, it is apparent that various changes can be made without departing from the scope of the invention as defined by the appended claims.

We claim:

1. A system of apparatus for producing wire harness assemblies, each assembly comprising a plurality of cable wires having opposed ends, a terminal mounted to at least one opposed end of each cable wire and at least one housing mounted to the respective terminals and cable wires, said system comprising a plurality of pallets to which said cables are mounted, conveying means for sequentially moving the pallets to at least a terminating station for mounting the terminals to the cable wires and an insertion station for inserting the terminals into the housing, wherein the improvement comprises:

each said pallet having at least one selectively expandable and collapsible wire fixture for simultaneously engaging at least three cable wires at a location adjacent but spaced from one of said opposed ends of each cable wire, said fixture defining a generally planar array of generally parallel cable wire ends defining a major pitch between the wires in an expanded condition of the fixture and a minor pitch between the wires in a collapsed condition of the fixture, said fixture including a frame and a plurality of separate wire holders movably mounted within said frame for holding and moving the respective separate cable wires, said wire holders being movable only in a plane perpendicular to said generally planar array; and means for collapsing the fixture at the insertion station of the system, whereby the minor pitch between the wires defined by the collapsed condition of the fixture corresponds to the pitch required for the insertion of the terminals into the housing.

2. A system as in claim 1 wherein the fixture comprises a plurality of separate wire holders for holding the respective cable wires and connecting means disposed intermediate the respective wire holders for urging the wire holders into selected spaced relationship to one another.

3. A system as in claim 2 wherein the expandable and collapsible fixture is mounted on the pallet, and wherein the connecting means comprises spring means for urging the wire holders into the expanded condition of the fixture.

4. A system as in claim 3 wherein each wire fixture further comprises at least one pin for selectively urging the wire holders of each fixture into the collapsed condition, and wherein the insertion station comprises means for engaging the pin and urging the wire holders into the collapsed condition.

5. A system as in claim 3 further comprising a stripping station for stripping insulation from the cable wires, the spring means for urging the wire holders into the expanded condition being operative to urge the fixtures into the expanded condition at the stripping station.

6. A system as in claim 1 wherein the expandable and contractible fixture is mounted to the insertion station, each said pallet comprising at least one rigid fixture with wire holders defining the major pitch therebetween, said insertion station comprising means for removing the wires from the rigid fixture and means for mounting the wires in the expandable and contractible fixture.

7. An apparatus for producing wire harness assemblies, each assembly comprising a plurality of cable wires having opposed ends with terminals mounted to said wires at one end of said cable wires and a housing at one of said ends with at least one of said terminals mounted therein, said apparatus comprising a terminating station for mounting the terminals to the cable wires and an insertion station for inserting the terminals into the housing, wherein the improvement comprises:

at least one selectively expandable and collapsible wire fixture for simultaneously engaging at least three cable wires at a location adjacent but spaced from one of said opposed ends of each cable wire, said fixture defining a generally planar array of generally parallel cable wire ends defining a major pitch between the wires in an expanded condition of the fixture and a minor pitch between the wires in a collapsed condition of the fixture, said fixture including a frame and a plurality of separate wire holders movably mounted within said frame for holding and moving the respective separate cable wires, said wire holders being movable only in a plane perpendicular to said generally planar array; and means for collapsing the fixture whereby the minor pitch between the wires defined by the collapsed condition of the fixture corresponds to the pitch required from the insertion of the terminals into the housing.

8. An apparatus as in claim 7 wherein the fixture comprises a plurality of separate wire holders for holding the respective cable wires and connecting means disposed intermediate the respective wire holders for urging the wire holders into selected spaced relationship to one another.

9. An apparatus as in claim 8 wherein the connecting means comprises spring means for urging the wire holders into the expanded condition of the fixture.

10. An apparatus as in claim 9 wherein each wire fixture further comprises at least one pin for selectively urging the wire holders of each fixture into the collapsed condition, and wherein the insertion station comprises means for engaging the pin and urging the wire holders into the collapsed condition.

11. An apparatus as in claim 9 further comprising a stripping station for stripping insulation from the cable wires, the spring means for urging the wire holders into the expanded condition being operative to urge the fixtures into the expanded condition at the stripping station.

12. An apparatus as in claim 1 wherein the expandable and contractible fixture is mounted to the insertion station, said apparatus includes a pallet comprising at least one rigid fixture with wire holders defining the major pitch therebetween, and said insertion station comprises means for removing the wires from the rigid fixtures and means for mounting the wires in the expandable and contractible fixture.

* * * * *